United States Patent [19]

Hsieh et al.

[11] Patent Number: 4,851,318

[45] Date of Patent: Jul. 25, 1989

[54] PROCESSES FOR ENCAPSULATED TONER COMPOSITIONS WITH OLIGOMERIC SURFACTANT EMULSIFIERS

[75] Inventors: Bing R. Hsieh, Webster; Robert J. Gruber, Pittsford; Richard F. Koehler, Webster, all of N.Y.

[73] Assignee: Xerox Corporation, Stamford, Conn.

[21] Appl. No.: 211,011

[22] Filed: Jun. 24, 1988

[51] Int. Cl.[4] ..... G03G 9/08

[52] U.S. Cl. ..... 430/137; 430/138; 428/402.24

[58] Field of Search ..... 430/137, 138

[56] References Cited

U.S. PATENT DOCUMENTS

| | | | |
|---|---|---|---|
| 4,307,169 | 12/1981 | Matkan | 430/111 |
| 4,407,922 | 10/1983 | Grushkin et al. | 430/98 |
| 4,476,210 | 10/1984 | Croucher et al. | 430/114 |
| 4,727,011 | 2/1988 | Mahabadi et al. | 430/138 |
| 4,758,506 | 7/1988 | Lok et al. | 430/111 X |

FOREIGN PATENT DOCUMENTS

| | | | |
|---|---|---|---|
| 63-121837 | 5/1988 | Japan | 430/138 |

*Primary Examiner*—Roland E. Martin

*Attorney, Agent, or Firm*—E. O. Palazzo

[57] ABSTRACT

An improved process for the preparation of encapsulated toner compositions which comprises mixing core monomer(s), an initiator, or initiators, pigment particles, and oil soluble shell monomer(s); homogenizing the aforementioned mixture into an aqueous surfactant solution resulting in an oil-in-water suspension; thereafter adding water soluble shell monomer(s) to the oil-in-water suspension enabling an interfacial polymerization reaction between the oil soluble and the water soluble shell monomer(s); subsequently adding a low molecular weight polyethylene oxide surfactant protective colloid; and thereafter affecting a free-radical polymerization of the core monomer(s) by heating.

25 Claims, No Drawings

PROCESSES FOR ENCAPSULATED TONER COMPOSITIONS WITH OLIGOMERIC SURFACTANT EMULSIFIERS

BACKGROUND OF THE INVENTION

The present invention is generally directed to processes for the preparation of encapsulated toner compositions, and more specifically the present invention is directed to processes for the formulation of encapsulated toner compositions with certain oligomeric surfactants by interfacial polymerization of shell-forming monomers in the presence of a free-radical initiator or initiator and monomer(s) and pigment particles contained in the core, and subsequent free-radical polymerization of the core monomers. Thus, in one embodiment the present invention is directed to a process for the economical preparation of heat fixable toner compositions by interfacial/free-radical polymerization methods wherein there is selected polyethylene oxide, or polyoxyethylene based surfactants. Other embodiments of the present invention relate to interfacial/freeradical polymerization processes for obtaining colored toner compositions. Additionally, the selection of monomer components for the process of the present invention enables a lower cost of production for the desired toner compositions, greater flexibility in the selection of core material properties, and a higher degree of core and toner physical property, for example size diameter control, than can be achieved with the polymers and solvents of the prior art. Also, with the toner compositions of the present invention wherein polyethylene oxide based surfactants are selected, there is avoided undesirable coagulation of toner particles; and these particles are substantially insensitive to relative humidities of, for example, from about 20 to about 80 percent. The aforementioned toners prepared in accordance with the process of the present invention are useful for permitting the development of images in electrophotographic imaging systems, inclusive of electrostatic imaging processes wherein pressure or heat fixing, is selected.

Encapsulated and cold pressure fixable toner compositions are known. Cold pressure fixable toners have a number of advantages in comparison to toners that are fused by heat, primarily relating to the requirements for less energy since the toner compositions used can be fused at room temperature. Nevertheless, many of the prior art cold pressure fixable toner compositions suffer from a number of deficiencies. For example, these toner compositions must usually be fused under high pressure, which has a tendency to severely disrupt the toner fusing characteristics of the toner selected. This can result in images of low resolution, or no images whatsoever. Also, with some of the prior art cold pressure toner compositions substantial image smearing can result from the high pressures used. Additionally, the cold pressure fixing toner compositions of the prior art have other disadvantages in that, for example, these compositions are prepared with solvents that may create explosion hazards; and further these solvents are costly in that separation and recovery equipment is required. Moreover, the selection of the aforementioned solvents may decrease the percentage yield of toner product obtained; and also these solvents limit flexibility requirements in the selection of the core polymer.

With further specific reference to the prior art, there is disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there is disclosed in the prior art encapsulated toner compositions containing pigments and dyes, reference for example the color photocapsule toners of U.S. Pat. Nos. 4,399,209; 4,482,624; 4,483,912 and 4,397,483.

Moreover, illustrated in a copending application U.S. Ser. No. 621,307, now U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. Ser. No. 718,676, now abandoned, the disclosure of which is totally incorporated herein by reference. In the aforementioned application, the core can be comprised of magnetite and a polyisobutylene of a specific molecular weight encapsulated in a polymeric shell material generated by an interfacial polymerization process.

Furthermore, in U.S. Pat. No. 4,727,011, the disclosure of which is totally incorporated herein by reference, there are illustrated processes for encapsulated toner compositions comprised of a core containing pigment particles, and a free-radical polymerized monomer(s) with an optional polymer, such as polyisobutylene, in an amount of from about 1 to about 5 percent by weight, and a shell generated by interfacial polymerization processes. More specifically, the process illustrated in this patent, which is accomplished in the absence of a solvent, is comprised of (1) mixing a blend of a core monomer, or monomers not exceeding five, free-radical chemical initiator, pigment, and a first shell monomer; (2) forming an organic liquid:solid suspension, in a stabilized aqueous suspension; (3) thereafter forming a liquid suspension; and (4) subsequently subjecting the aforementioned mixture to an interfacial polymerization by the addition of a water-soluble second shell monomer. After the polymerization is complete, a free-radical polymerization is initiated by increasing the temperature of the suspension, for example, to 75° C., and thus commencing the disassociation of the chemical initiator to free-radicals capable of polymerizing the core monomer(s). Moreover, for obtaining particles with narrow size distributions, that is toner particles with an average diameter of from about 10 to about 35 microns, and geometric size dispersities of less than 1.20, subsequent to the interfacial polymerization step the toner product can be submitted to a free-radical polymerization permitting the particles to agglomerate and polymerize together through partially formed shells. These partially formed shells can be produced by reducing the degree of homogeneity of the original blend of shell material thus biasing the distribution of shell material in favor of large particles, and promoting interparticle polymerization and growth of smaller particles resulting in a narrowing of the size distribution. As stabilizers, there are disclosed in the '011 patent polymeric water soluble molecules such as polyvinylalcohols, reference for example page 10 thereof. Also, the process of the present invention is directed to the preparation of encapsulated toner compositions which comprises mixing in the absence of solvent core monomer, an initiator, pigment particles, monomer(s), stabilizer and water; thereafter adding a second shell monomer thereby enabling an interfacial polymerization reaction between the first and second shell monomers; and subsequently affecting a free-radical polymerization of the core monomer.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as polyvinyl pyrrolidone. Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphiphilic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

Free-radical polymerization is also well known in the art, and can be generalized as bulk, solution, or suspension polymerization. These polymerizations are commonly selected for the preparation of commodity polymers. The kinetics and mechanisms for free-radical polymerization of monomer(s) are also well known. In these processes, the control of polymer properties such as molecular weight and molecular weight dispersity can be affected by initiator, species concentrations, temperatures, and temperature profiles.

Many prior art processes provide deleterious effects on toner particle morphology and bulk density as a result of the removal of solvent, and the subsequent collapse of the toner particles during particle isolation resulting in a toner of very low bulk density, which disadvantages are substantially eliminated with the process of the present invention. More specifically, thus with the process of the present invention control of the toner physical properties of both the core and shell materials is permitted. Additionally, the toner compositions prepared in accordance with the process of the present invention have hard shells thus enabling images of excellent resolution with substantially no background deposits for a number of imaging cycles, and toner aggolmeratrion is avoided. Also, the toner compositions prepared in accordance with the process of the present invention contain as a protective stabilizing colloid a polyethylene oxide surfactant which enables minimum coagulation of the resulting particles, and are insensitive to relative humidity of, for example, from about 20 to about 80 percent.

Accordingly, there is a need for improved processes for the preparation of encapsulated toner compositions. Also, there is a need for interfacial polymerization processes for black and colored encapsulated toner compositions, wherein the core contains a polymerizable monomer and free-radical initiator together with pigments and other materials, and wherein there is selected as surfactants, or protective colloids polyethylene oxide based components. There is also a need for simple, economical processes for the preparation of encapsulated toner compositions in high yields, which processes are affected in the presence of polyethylene oxide, or polyoxyethylene based components. Additionally, there is a need for simple economical polymerization processes that will permit the generation of encapsulated toner compositions, especially compositions with hard, durable shells, excellent toner flowability, and wherein these compositions are insensitive to relative humidities of from about 20 to about 80 percent. Furthermore, there is a need for improved processes that will enable toner compositions with hard shells and soft cores, whose properties such as molecular weight, molecular weight dispersity, and degree of crosslinking can be independently controlled. Moreover, there is a need for processes for the preparation of encapsulated toners wherein coagulation of the toner particles is avoided. Additionally, there is a need for processes for the preparation of encapsulated toners wherein the volume average toner particle size is from about 5 to about 30 microns with GSD of from about 1.3 to about 1.8. In addition, there is a need for process that will enable the fabrication of toner particles with clean surfaces, that is wherein the surfaces are free from surfactants and ultrafine particles with, for example, an average particle diameter of less than 1 micron. Furthermore, there is a need for the rapid economical preparation of toner compositions wherein low molecular weight polyoxyethylene surfactants, which can be removed easily by washing with water, are selected. Moreover, there is a need for increasing the concentration by, for example, an amount of from about 5 to about 15 weight percent of pigment particles within the toner compositions illustrated herein by selecting polyethylene oxide based components as surfactants, and protective colloids.

SUMMARY OF THE INVENTION

It is an object of the present invention to provide processes for encapsulated toner compositions with many of the advantages illustrated herein.

In another object of the present invention there are provided simple, and economical processes for black and colored toner compositions formulated by an interfacial/free-radical polymerization process wherein there are selected polyethylene oxide based components as surfactants.

Another object of the present invention resides in simple, and economical processes for black, and colored heat pressure fixable toner compositions with hard shells formulated by an interfacial/free-radical polymerization process wherein there is selected polyethylene oxide based components as surfactants, and the resulting toner compositions are insensitive to humidity of from about 20 to about 80 percent.

Further, an additional object of the present invention resides in economical processes for the preparation of encapsulated toners by interfacial/free-radical polymerization processes wherein high yields of product are obtained, and wherein there is selected polyethylene oxide based components as emulsifiers or protective colloids, which function primarily as a steric stabilizer to prevent coagulation during the core polymerization. Generally, a solution of low molecular weight surfactant is added after the interfacial shell formation has been completed. The resulting mixture is then heated to 75° C. to polymerize the core.

An additional object of the present invention resides in the provision of improved flexibility in the control and design of toner materials in that virtually any core material property can be attainable by simple formulation modifications.

These and other objects of the present invention are accomplished by the provision of processes for encapsulated toner compositions comprised of a core containing a pigment particles, and a polymerizable monomer, or monomers, such as free-radical polymerizable monomer, or monomers; a polymerization initiator or initiators; and a shell generated by interfacial polymerization processes. More specifically, the process of the present invention comprises (1) mixing a blend of a core monomer, or monomers, preferably not exceeding five, initiator, pigment particles, and oil soluble shell monomer(s); (2) forming an oil-in-water suspension by homogenization of the aforementioned mixture and an aqueous surfactant solution; (3) subsequently subjecting the aforementioned suspension to an interfacial polymerization by addition of a water soluble shell monomer, or monomers. After the polymerization is complete, (4) there is added to the suspension a low molecular weight polyethylene oxide surfactant as a protective colloid. Free-radical polymerization (5) is initiated by heating the suspension, for example, to 75° C., thus commencing the free-radical polymerization of the core monomer, or core monomers.

Accordingly, in one specific embodiment of the present invention there is provided a process for the preparation of encapsulated toner compositions, which comprises mixing core monomer(s), initiator(s), pigment particles, and oil soluble shell monomers resulting in an organic pigment dispersion; homogenizing the aforementioned mixture into a surfactant solution resulting in an oil-in-water suspension; thereafter adding water soluble shell monomers enabling an interfacial polymerization reaction between the oil soluble and water soluble shell; and subsequently adding a low molecular weight polyethylene oxide surfactant as a protective colloid; and thereafter affecting a free-radical polymerization of the core monomer, or monomers by heating.

Further, another object of the present invention resides in the process for the preparation of encapsulated toner compositions, which comprises mixing core monomers, initiators, pigment particles, and oil soluble shell monomers resulting in an organic pigment dispersion; subsequently adding thereto a surfactant solution comprised of a high molecular weight polyethylene oxide in water; thereafter adding water soluble shell monomers whereby an interfacial polymerization reaction between said shell monomers occurs; subsequently adding a low molecular weight polyethylene surfactant as a protective colloid; and thereafter affecting a free-radical polymerization of the core monomer by heating.

In one illustrative specific embodiment, the present invention is directed to processes for the preparation of encapsulated toners, which comprises preparing a dispersion of pigment particles, containing a monomer core and a polymerization initiator; thereafter dispersing the aforementioned pigment dispersion components into an aqueous solution containing a polyethylene oxide based component surfactant; and thereafter adding water soluble shell monomers permitting encapsulation of the core by affecting polymerization of the shell monomers; and thereafter heating the encapsulated composition enabling polymerization of the core monomers.

Another specific embodiment of the present invention is directed to a process for the preparation of encapsulated toner compositions, which comprises mixing core monomer(s), an initiator, or initiators, pigment particles, and oil soluble shell monomer(s); adding to the aforementioned mixture an aqueous surfactant solution resulting in an oil in water suspension; thereafter adding water soluble shell monomer(s) to the oil-in-water suspension enabling an interfacial polymerization reaction between the oil soluble and the water soluble shell monomer(s); subsequently adding a low molecular weight polyethylene oxide surfactant protective colloid; and thereafter affecting a free-radical polymerization of the core monomer(s) by heating. Further, in another embodiment of the present invention there is provided a process for the preparation of encapsulated toner compositions, which comprises mixing core monomer(s), initiators, pigment particles, and oil soluble shell monomer(s) resulting in an organic pigment dispersion; adding the aforementioned organic pigment dispersion to an aqueous surfactant solution resulting in an oil-in-water suspension; thereafter adding water soluble shell monomer(s) to the oil-in-water suspension enabling an interfacial polymerization reaction between the oil soluble and the water soluble shell monomer(s); subsequently adding a polyethylene oxide surfactant protective colloid; and thereafter affecting a free-radical polymerization of the core monomer(s) by heating. Moreover, there is provided with the present invention an improved process for the preparation of encapsulated toner compositions, which comprises mixing core monomers, initiators, pigment particles, and oil soluble shell monomers resulting in an organic pigment dispersion; adding the aforementioned mixture to a surfactant solution resulting in an oil-in-water suspension; thereafter adding water soluble shell monomers to the oil-in-water suspension enabling an interfacial polymerization reaction between the oil soluble and water soluble shell monomers; subsequently adding a low molecular weight polyethylene oxide surfactant as a protective colloid; and thereafter affecting a free radical polymerization of the core monomer by heating.

Specifically, in one embodiment the process of the present invention comprises the preparation of a core composition containing 5 to 15 weight percent of pigment or pigment particles, 2 to 10 weight percent of a pigment dispersant, 20 to 30 weight percent of a preformed toner resin, such as styrene acrylates, styrene methacrylates, especially styrene butylmethacrylates, and styrene butadienes; 40 to 70 weight percent of core monomers, 5 to 20 weight percent of a shell monomer(s), and 0.5 to 1.0 weight percent of radical initiator. The core composition can be prepared by various mixing methods such as shaking, ball milling, or attrition. Usually prolonged mixing for a period of from about 10 to 24 hours is selected to ensure a high degree of pigment dispersion, that is about 90 percent. Also, the initiator and the shell monomer are not present during the mixing process, rather they are added after a high quality pigment dispersion, which is an agglomerate-free dispersion, has been achieved. The resulting mixture is then added to an aqueous emulsifier solution containing 2 to 5 weight percent of a polyethylene oxide type surfactant and about 2 weight percent of an inhibitor, typically potassium iodide. Small amounts, about 0.5 percent, of a coemulsifier such as polyvinyl alcohol or polyvinyl pyrrolidone may be present to enhance the emulsification properties. Catalytic amounts of a phase transfer catalyst, such benzyltriethyl ammonium chloride, for interfacial polymerization may also be selected, especially for formation polyester shells. Typically, 100 parts of the core material is dispersed into 500 parts of the emulsifier solution by means of high shear and high speed (5,000 to 10,000 rpm) mixing, such as homogenization or ultrasonification, to give a stable oil-in-water suspension. The aforementioned efficient mixing process permits short mixing times of, for example, from about 10 to about 60 seconds. An alkaline solution containing the water soluble shell monomer is then added to enable interfacial polymerization. After 1 to 3 hours, 1,000 part of a two percent protective colloid solution is added to the reaction mixture. Low molecular weight polyethylene oxide surfactants are preferred protective colloids. The resulting suspension of the encapsulated particles is then heated to 75° C. for 15 to 18 hours, and 85° C. for another 5 to 10 hours to polymerize the core monomers. The resulting particles are washed thoroughly with water to remove the surfactants and then spray or freeze dried to provide toner compositions in about 60 to 80 percent yields. Also, the toner compositions obtained usually have average particle sizes of from about 10 to about 20 microns as determined by Coulter Counter.

Further, in accordance with the present invention there are provided processes for black and colored cold, or heat pressure fixable toner compositions, which process comprises mixing with from about 50 to about 60 weight percent of core monomer(s) such as butyl acrylate, lauryl methacrylate, hexyl methacrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, m-tolyl acrylate, dodecyl styrene, hexyl methyl styrene, nonyl styrene, tetradecyl styrene, or other substantially equivalent vinyl monomers; and combinations of vinyl monomers with an azo type free-radical initiators such as azoisobutyronitrile, azodimethylvaleronitrile, azobiscyclohexanenitrile, 2-methylbutyronitrile, or mixtures thereof; pigments including colored pigments in an amount of from about 5 to about 70 percent by weight, such as magnetites, colored magnetites, carbon blacks, other solid inert materials of particle size of 0.5 to 1 micron; and shell comonomers, such as toluene diisocyanate, sebacoyl chloride, adipic acid, toluene bischloroformate, hexanedisulfonic acid, chloride and a shell crosslinking agent such as Desmodur RF (Bayer); and subsequently by the addition of a water soluble shell comonomer, such as diethylene triamine, hexane diamine, hexmethylenediamine, bisphenol A or other water soluble copolycondensation coreactant to the suspension, accomplishing an interfacial polymerization at the interface of the aforementioned mixture to provide a suspension of encapsulated particles. Thereafter, there is affected a free-radical polymerization by heating the suspension and allowing the disassociation of chemical initiator to freeradicals. Free-radical polymerization by the reaction with core monomer(s) is then initiated. Prior to the polymerization, a solution of a low molecular weight polyethylene oxide surfactant is added to the suspension of the encapsulated particle to ensure particle stability during the core polymerization.

Illustrative examples of core monomers present in an amount of from about 10 to about 70 percent by weight include acrylates, methacrylates, diolefins, and the like. Specific examples of core monomers are butyl acrylate, butyl methacrylate, lauryl methacrylate, hexyl methacrylate, hexyl acrylate, styrene, cyclohexyl acrylate, dodecyl acrylate, ethoxy propyl acrylate, heptyl acrylate, isobutyl acrylate, methyl butyl acrylate, m-tolyl acrylate, dodecyl styrene, hexyl methyl styrene, nonyl styrene, tetradecyl styrene, other known vinyl monomers, reference for example U.S. Pat. No. 4,298,672, the disclosure of which is totally incorporated herein by reference, mixtures thereof; and the like.

Illustrative examples of free-radical initiators include azo compounds such as 2-2'-azodimethylvaleronitrile, 2,2'-azoisobutyronitrile, and other similar known compounds, with the ratio of core monomer to initiator being from about 100/1 to about 100/10. Radical initiators also include epoxides such as dicumyl-peroxide, dilauroyl peroxide, t-butyl perbenzoate, and the like. Stabilizers, including emulsifiers and protective colloids, selected for the process of the present invention include oligomeric and polymeric water soluble surfactants, such as copolymer of ethylene oxide and propylene oxide with molecular weights ranging from 10,000 to 20,000, with a stabilizer-to-water ratio of about 4 weight percent. Coemulsifiers are water soluble polymeric surfactants of relatively high molecular weights, for example, polyvinyl alcohols or polyvinyl pyrrolidone with number average of about 20,000 to 100,000, at about 0.5 weight percent.

Various known pigments, present in an amount of from about 5 to about 75 percent by weight, can be selected inclusive of carbon black, magnetites, such as Mapico Black, Mobay MO8029, MO8060, Columbia Pigments magnetites, and Pfizer magnetites, and other equivalent black pigments. As colored pigments, there can be selected Heliogen Blue L6900, D6840, D7080, D7020, Pylam Oil Blue and Pylam Oil Yellow, Pigment Blue 1 from Paul Uhlich & Co. Inc., Pigment Violet 1, Pigment Red 48, Lemon Chrome Yellow DCC 1026, E.D. Toluidine Red and Bon Red C from Dominion Color Corp. Ltd., Toronto, Ont., NOVAperm Yellow FGL, Hostaperm Pink E from Hoechst, Cinquasia Magenta from E.I. DuPont de Nemours & Co., and Oil Red 2144 from Passaic Color and Chemical. Further, useful colored pigments that can be used are cyan, magenta, or yellow pigments, and mixtures thereof. Examples of magenta materials that may be selected as pigments include, for example, 2,9-dimethylsubstituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra4(octadecyl sulfonamido) phthalocyanine, X-copper phthalocyanine pigment listed in the Color Index as CI 74160, CI Pigment Blue, and Anthrathrene Blue identified in the Color Index as CI 69810, Special Blue X2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy aceto-acetanilide, and Permanent Yellow FGL. The aforementioned pigments are incorporated into the encapsulated toner compositions in various suitable effective amounts providing the objectives of the present invention are achieved. In one embodiment, these colored pigment particles are present in the toner composition in an amount of from about 2 percent by weight to about 15 percent by weight calculated on the weight of the dry toner. Colored magnetites, such as mixtures of Mapico Black, and cyan components may also be used as pigments with the process of the present invention.

Polyethylene oxide surfactants include commercially available materials such as Pluronics, Tetronics, Pluronic R and Tetronic R from BASF, which are nonionic block polymers containing polyethylene oxide and polypropylene oxide blocks. These types of block polymers are also available from GAF, Dow Chemical, Union Carbide and Witco Chemical, inc.. Also, these materials generally have weight average molecular weight of from about 10,000 to about 25,000, and HLB values of from about 10 to greater than about 30, and preferably about 50. The surfactants can also be selected as the protective colloids.

Also, there may be selected as surfactants alcohol ethoxylates and alkylphenol ethoxylates. With further regard to the process of the present invention, the high molecular weight polyethylene surfactants have a number average molecular weight generally of from about 10,000 to about 20,000 while the low molecular weight polyethylene oxide surfactant utilizes a protective colloid having a number average molecular weight of about 1,000 to about 10,000.

Alcohol ethoxylates and alkylphenol ethoxylates are classes of useful protective colloids. There are many useful commercial alcohol ethoxylates such as Antaroxs available from GAF, Brijs from ICI, Neodols from Shell Chemical, and the like of the following general formula $$R—(OCH_2CH_2)_n—OH$$

wherein R is an alkyl substituent, and n represents the number of repeating units, preferably from about 40 to about 100.

Igepals available from GAF, and Tritons available from Rohm and Haas are commercial alkylphenol ethoxylates of the following formula

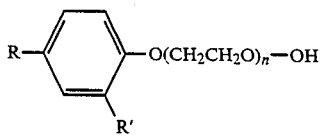

wherein R is an alkyl substituent, R' is hydrogen or an alkyl substituent, and n is a number of from about 20 to about 100. Preferred ethoxylates include those wherein R is $C_8H_{17}$, $C_9H_{19}$, $C_{12}H_{25}$ or alkyl; and R' are —H or -alkyl.

Another class of useful protective colloids is polyoxyethylene derivatives of sorbitan fatty acid esters such as those available from Imperial Chemical, Inc.

Examples of shell polymers resulting, for example, from the reaction of a first shell monomer, and a second shell monomer, each present in an amount of from about 2.0 to about 20.0 percent by weight, are polyureas, polyamides, polyesters, polyurethanes, and the like. The second shell monomer may include water soluble amines, including primary and secondary, and bisphenols. The first shell monomer can include organic soluble isocyanates, including dimeric and trimeric isocyanates, toluene diisocyanate, sebacoyl chloride, or terephthalaloyl chloride, isophthaloyl chloride, phthaloyl halides, and the like. The resulting shells are generally 5 to 30 percent by weight of the toner, and with a thickness generally less than about 2 microns. The aforementioned shell polymers are generally present in an amount of from about 10 to about 30 percent by weight of the toner, and further thickness of the shell is usually less than about 2 microns. Other shell polymers, shell amounts, and thicknesses can be selected provided the objectives of the present invention are achievable. Copolymers can also be selected as the shell materials to modify the fusing, charging, or mechanical, or thermal properties of the toner. Copolymer shell materials can be prepared by incorporating more than one oil or water soluble shell monomer. The toner properties can also be modified by the use of polyfunctional shell monomer to give branched or crosslinked shell polymer. Furthermore, the molecular weight of the shell polymer can be controlled by the use of a monofunctional shell reactant. Moreover, in accordance with the process of the present invention there may be added and mixed with the core monomers, for purposes of core material property control and enhancement, polymers such as styrene-butadienes, polyvinylethers, polybutadienes, and polysiloxanes, or core crosslinking agents such as divinylbenzene, core plasticizers such as dioctyladipate or pentaerythritol tetrabenzoates.

Interfacial processes selected for the shell formation are as illustrated, for example, in U.S. Patents 4,000,087 and 4,307,169, the disclosures of which are totally incorporated herein by reference.

The following examples are being submitted to further define various species of the present invention. These examples are intended to be illustrative only and are not intended to limit the scope of the present invention. Also, parts and percentages are by weight unless otherwise indicated.

EXAMPLE I

Into a 250 milliliter PP (polypropylene) bottle was added duPont Elvacite pigment dispersant AB 1020, 2 grams (g), styrene (70 g) and butyl methacrylate (BMA, 60 g). The mixture was then shaken on a paint mixer apparatus for 10 minutes and the AB 1020 was completely dissolved. Predispersed Hostaperm Pink E (48 g) and a solution of 50 percent by weight of a styrene-n-butylmethacrylate polymer in styrene (30 g) was then added to the aforementioned mixture. Thereafter, the resulting mixture was shaken overnight with a Burrel wrist action shaker. AIBN 2,2'-azo-bisisobutyronitrile (1.5 g), VAZO 52 2,2'-azo-bis(2,4-dimethyl valeronitrile) (1.5 g), isophthaloyl chloride (20 g) and 1,3,5 benzenetricarboxylic acid chloride (10 g) were then added to the mixture, which was subsequently homogenized with a Brinkmann homogenizer with a 20 TSM generator at 8,000 rpm for 1 minute to provide a pigment dispersion. A portion of the pigment dispersion (80 g) was then added quickly to a homogenizing (8,000 rpm) 2 percent polyvinylalcohol (PVA) (MW=96,000; 88 percent hydrolyzed) solution ( 500 milliliters containing 1 g Ki (potassium iodide)). Homogenization was continued for 10 seconds to provide an o/w (oil-in-water)

suspension. The resulting mixture was then transferred into a 2 liter reaction kettle equipped with mechanical stirrer, condenser, two addition funnels containing 25 percent $K_2CO_3$ (40 milliliters) and 25 percent 2-methyl pentamethylenediamine (40 milliliters) separately. The amine and $K_2CO_3$ solutions were added simultaneously over a period of less than 1 minute to the suspension while stirring mechanically (140 rpm). After stirring for 3 hours, a protective colloid solution (1 killogram, 2 percent Pluronic L43 weight average molecular weight 1,850) was then added to the aforementioned mixture. The resulting mixture was the heated at 75° C. for about 16 hours, at 85° C. for 5 hours, and then transferred into a 4 liter beaker. The resulting toner was then washed with water (3L×10), sieved through a combination of 425 and 250 microns sieves, and spray dried to provide a toner (65 g, 60 percent) with an average particle size of 16 microns, and GSD of 1.8 as determined by Coulter Counter.

EXAMPLE II

A portion of the pigment dispersion as described in Example I (105 g) was added quickly (about 2 seconds) to a homogenizing (8,000 rpm) 2 percent PVA (MW=96,000; 88 percent hydrolyzed) solution (500 milliliters containing 1 g Kl). Homogenization was continued for 10 seconds to give an o/w suspension. The resulting mixture was transfered into a 2 liter reaction kettle equipped with mechanical stirrer, condenser, two addition funnels containing 25 percent $K_2CO_3$ (40 milliliters) and 25 percent 2-methyl pentamethylenediamine (40 milliliters) separately. The amine and $K_2CO_3$ solutions were added simultaneously in about 1 minute to the suspension with stirring mechanically (140 rpm). After stirring for 3 hours, a protective colloid solution (1 killigram, 2 percent Igepal CO 880, number average molecular weight of 1,500) was added. The resulting mixture was then heated at 75° C. for 15 hours, at 85° C. for 5 hours, and then transferred into a 4 liter beaker. The resulting toner was washed with water (3L×10), sieved through a combination of 425 and 250 microns sieves, and spray dried to provide a toner (65 g, 60 percent) with average particle size of 16 microns, and GSD of 1.9.

EXAMPLE III

Into a 250 milliliter PP bottle was added duPont Elvacite pigment dispersant AB 1020 (2 g), styrene (St, 45 g) and butyl methacrylate (BMA, 45 g). The mixture was shaken until AB 1020 was completely dissolved. Predispersed Hostaperm Pink E (40 g) and a solution of 60 weight percent of styrene-n-butyl methacrylate polymer in styrene (50 g) were added. The resulting mixture was shaken overnight with a Burrel wrist action shaker. AIBN (2 g), VAZO 52 (2 g), isophthaloyl chloride (30 g) was added, and the mixture was homogenized with a Brinkmanm homogenizer with a 20 TSM generator at 8,000 rpm for 1 minute yielding a pigment dispersion. A portion of the pigment dispersion (65 g) was added quickly to a homogenizing (8,000 rpm) 4 percent Pluronic F108, molecular weight number average of 14,600 (500 milliliters containing 10 g of Ki). Homogenization was continued for 10 seconds yielding an o/w suspension. This suspension was then transferred into a 2 liter reaction kettle equipped with mechanical stirrer, condenser, two addition funnels containing 25 percent $K_2CO_3$ (40 milliliters) and 25 percent 2-methyl pentamethylenediamine (40 milliliters) separately. The base and amine solutions were quickly added simultaneously to the suspension while stirring mechanically (140 rpm). After stirring for 3 hours, a protective colloid solution (1 killigram, 2 percent Igepal CO 970) number average molecular weight of 2,300 was then added. The resulting mixture was then heated at 75° C. for at least 15 hours, at 85° C. for 5 hours, and then transferred into a 4 liter beaker. The resulting toner was washed with water (3L x 10), sieved through a combination of 425 and 250 microns sieves, and spray dried to give a toner (30 g, 50 percent) with an average particle size of 16 microns, and GSD of 1.8.

EXAMPLE IV

A pigment dispersion of the following composition was prepared substantially as described in Example I: AB 1020 (2 g), styrene (100 g), n-butyl methacrylate (100 g), 60 weight percent of styrene-n-butyl methacrylate in styrene (100 g), isophthaloyl chloride (60 g), AIBN (2 g), VAZO 52 (2 g). A solution of bisphenol A was prepared according to the following procedure. Sodium hydroxide (8 g) was added into a 150 milliliter PP bottle containing ice water (100 g). After NaOH had been solubilized, bisphenol A (22.8 g), $K_2CO_3$ (10 g) and benzyltriethyl ammonium chloride (BTEAC, 1.0 g) were added. The mixture was shaken until a solution was obtained. An emulsifier solution having 4 percent Pluronic F108 and 0.4 percent PVA (MW =3,000, 75 percent hydrolyzed) was also prepared. A portion of the pigment dispersion (90 g) was added to the homogenizing emulsifier solution (600 g). Homogenization probe, speed, and duration were 35/4G, 7,000 rpm, and 12 seconds, respectively, to give an o/w suspension. This was transferred into a 2 liter reaction kettle and was stirred mechanically. A portion of the bisphenol A solution (87 g) was added all at once. The mixture was stirred for 10 minutes, and an additional bisphenol A solution (13 g) was added. The resulting mixture was stirred at room temperature for 2 hours. A protective colloid solution (1,000 g, containing 30 g Igepal CO 887, weight average molecular weight of 1,500 and 10 g of Ki) was added. The mixture was then heated at 70 to 75° C. for 14 hours, and then at 85° C. for 6 hours. The mixture was transferred into a 4 liter beaker and washed with water (3L×10), sieved through a combination of 425 and 250 microns sieves, and spray dried to give a toner (40 g, 60 percent) with an average particle size of 16 microns, and GSD of 1.8.

EXAMPLE V

A pigment dispersion of the following composition was prepared substantially as described in Example I: AB 1020 (3 g), styrene (50 g), n-butyl methacrylate (50 g), 60 weight percent of styrene-nbutylmethacrylate polymer in styrene (50 g), isophthaloyl chloride (20 g), AIBN (1 g), VAZO 52 (1 g). A solution of bisphenol A was prepared according to the following procedure. Potassium hydroxide (14.5 g) was added into a 250 milliliter PP bottle containing ice water (200 g). After KOH had been solubilized, bisphenol A (25 g), and $K_2CO_3$ (20 g) were added. The mixture was shaken to give a bisphenol A solution. An emulsifier solution having 4 percent Pluronic F108 and 0.4 percent PVA (MW=3,000, 75 percent hydrolyzed) was also prepared. The pigment dispersion (91 g) was added to the homogenizing emulsifier solution (600 g, with 0.65 g of BTEAC added). The homogenization probe, speed, and duration were 36/2G, 7,000 rpm, and 10 seconds, respectively, to yield a o/w suspension. This was transferred into a 2 liter reaction kettle and was stirred mechanically. A portion of the bisphenol A solution (35 g) was added all at once. The mixture was stirred for 10 minutes and an additional bisphenol A solution (13 g) was added. The resulting mixture was stirred at room temperature for 2 hours. A protective colloid solution (900 g, containing 18 g Pluronic F 38, weight average molecular weight of 1,400 and 15 g Kl) was added. The mixture was then heated at 70 to 75° C. for 7 hours, and then at 85° C. for 10 hours. The mixture was transferred into a 4 liter beaker and washed with water (3L×10), sieved through a combination of 425 and 250 microns sieves, and spray dried to give a toner (40 g, 60 percent) with an average particle size of 16 microns, and GSD of 1.8.

EXAMPLE VI

An attrited pigment concentrate consisting of 15 percent of Hostaperm Pink E, 6 percent of a pigment dispersant, and 79 percent of butyl methacrylate, provided by duPont was used to prepare pigment dispersion in this example. The concentrate (100 g), a solution of 50 weight percent of styrene-n-butyl methacrylate polymer in styrene, 100 grams, was shaken for 5 hours. Isophthaloyl chloride (13 g), AIBN (1 g), and VAZO 52 (1 g) were then added. A solution of bisphenol A was also prepared according to the following procedure. Sodium hydroxide (8.8 g) was added into a 150 milliliter PP bottle containing ice water (100 g). After KOH had been solubilized, bisphenol A (15 g), and $K_2CO_3$ (10 g) were added. The mixture was shaken until a solution was obtained. An emulsifier solution having 4 percent Pluronic F108 and 0.4 percent PVA (MW=96,000, 88 percent hydrolyzed) was also prepared. A portion of the pigment dispersion (95 g) was added to the homogenizing emulsifier solution (500 g, containing 10 g of Ki), homogenization probe, speed, and duration were 35/4G, 8,000 rpm, and 30 second, respectively, to yield an o/w suspension. This was transferred into a 2 liter reaction kettle and was stirred mechanically. A portion of the bisphenol A solution (52 g) was added all at once. The mixture was stirred for 10 minutes and a solution of t-butylphenol (15g, prepared from 5 g t-butyl phenol, 2.5 g KOH and 22.5 g water) was added. The resulting mixture was stirred at room temperature for 1 hour. A protective colloid solution (1,000 g, containing 20 g of Pluronic F38 and 10 g of Ki) was added. The mixture was then heated at 75° C. for 20 hours and then at 85° C. for 4 hours. The mixture was transferred into a 4 liter beaker and washed with water (3L×10), sieved through a combination of 425 and 250 microns sieves, and spray dried to yield a toner (40 g, 60 percent) with an average particle size of 13 microns, and GSD of 1.8.

When the toner compositions of the above examples, particularly Example III, were incorporated into a xerographic imaging test fixture with a positively charged selenium photoreceptor, there resulted images of excellent resolution with no background deposits, which images were fixed with heat.

Other modifications of the present invention may occur to those skilled in the art based upon a reading of the present disclosure, and these modifications are intended to be included within the scope of the present invention.

What is claimed is:

1. An improved process for the preparation of encapsulated toner compositions which comprises mixing core monomer(s), an initiator, or initiators, pigment particles, and oil soluble shell monomer(s); homogenizing the aforementioned mixture into an aqueous surfactant solution resulting in an oil-in-water suspension; thereafter adding water soluble shell monomer(s) to the oil-in-water suspension enabling an interfacial polymerization reaction between the oil soluble and the water soluble shell monomer(s); subsequently adding a low molecular weight polyethylene oxide surfactant protective colloid; and thereafter affecting a free-radical polymerization of the core monomer(s) by heating.

2. An improved process for the preparation of encapsulated toner compositions which comprises mixing core monomer(s), initiators, pigment particles, and oil soluble shell monomer(s) resulting in an organic pigment dispersion; adding the aforementioned organic pigment dispersion to an aqueous surfactant solution resulting in an oil-in-water suspension; thereafter adding water soluble shell monomer(s) to the oil-in-water suspension enabling an interfacial polymerization reaction between the oil soluble and the water soluble shell monomer(s); subsequently adding a polyethylene oxide surfactant protective colloid; and thereafter affecting a free-radical polymerization of the core monomer(s) by heating.

3. A process in accordance with claim 1 wherein heating is accomplished at a temperature of from about 70° to about 85° C.

4. A process in accordance with claim 1 wherein the surfactant solution is comprised of a high molecular weight polyethylene oxide and water.

5. A process in accordance with claim 4 wherein the weight average molecular weight of the polyethylene oxide is from about 10,000 to about 25,000.

6. A process in accordance with claim 1 wherein the number average molecular weight of the polyethylene oxide protective colloid is from about 1,000 to about 10,000.

7. A process in accordance with claim 2 wherein the polyethylene oxide surfactant is of a weight average molecular weight of from about 10,000 to about 25,000.

8. A process in accordance with claim 2 wherein the polyethylene oxide protective colloid is of a number average molecular weight of from about 1,000 to about 10,000.

9. A process in accordance with claim 2 wherein the free radical polymerization of the core monomers is accomplished by heating at a temperature of from about 70° to about 85° C.

10. A process in accordance with claim 1 wherein the core monomer(s) are selected in an amount of from about 40 to about 70 percent, the shell monomer(s) are selected in an amount of from about 5 to about 20 percent, and the pigment particles are selected in an amount of from about 5 to about 15 percent.

11. A process in accordance with claim 6 wherein the free radical polymerization is accomplished by inducing initiator decomposition in the core by heating.

12. A process in accordance with claim 1 wherein the core monomer is selected from the group consisting of alkyl acrylates, alkyl methacrylates, styrene, and styrene derivatives.

13. A process in accordance with claim 12 wherein the core monomer is selected from the group consisting of butyl acrylate, lauryl methacrylate, hexyl methacrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, m-tolyl acrylate, dodecyl styrene, hexyl methyl styrene, nonyl styrene, tetradecyl styrene, and mixtures thereof.

14. A process in accordance with claim 1 wherein the initiator is an azo or epoxide compound.

15. A process in accordance with claim 1 wherein the pigment particles are selected from the group consisting of carbon black, magnetites, cyan, magenta, yellow, red, blue, and mixtures thereof.

16. A process in accordance with claim 1 wherein the shell is polyurea, polyester, polyurethane, or polyamide.

17. A process in accordance with claim 1 wherein the free-radical polymerization is accomplished, subsequent to the interfacial shell polymerization, by thermal decomposition of a core resident free radical chemical initiator, and subsequent reaction and addition polymerization with a core resident vinyl monomer in the presence of pigment particles.

18. A process in accordance with claim 1 wherein the surfactants are polyethylene oxides selected from the group consisting of Pluronics, Tetronics, Pluronic R, and Tetronic R.

19. A process in accordance with claim 1 wherein surfactants are polyethylene oxides selected from alcohol ethoxylates, alkylphenol ethoxylates, and polyoxyethylene derivatives of sorbitan fatty acid esters.

20. A process in accordance with claim 1 wherein the core contains about 5 monomers.

21. A process in accordance with claim 1 wherein the toner is free of coagulation during core polymerization.

22. A process in accordance with claim 1 wherein the resulting toner is insensitive to relative humidities of from about 20 to about 80 percent.

23. A process in accordance with claim 1 wherein the resulting toner particle surfaces are substantially free of surfactant adsorption.

24. A process in accordance with claim 1 wherein the pigment particles are completely embedded within the toner core.

25. A process in accordance with claim 1 wherein the resulting toner particle shells possess a thickness of from about 0.1 to about 1 micron.

* * * * *